US010144031B2

(12) United States Patent
Sugai

(10) Patent No.: US 10,144,031 B2
(45) Date of Patent: Dec. 4, 2018

(54) FLUID EJECTION DEVICE

(71) Applicant: Seiko Epson Corporation, Tokyo (JP)

(72) Inventor: Keigo Sugai, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/443,250

(22) Filed: Feb. 27, 2017

(65) Prior Publication Data

US 2017/0252770 A1 Sep. 7, 2017

(30) Foreign Application Priority Data

Mar. 3, 2016 (JP) ..... 2016-040814

(51) Int. Cl.

| | |
|---|---|
| ***B05B 17/06*** | (2006.01) |
| ***B41J 2/045*** | (2006.01) |
| ***B05C 5/00*** | (2006.01) |
| *B41J 2/14* | (2006.01) |

(52) U.S. Cl.

CPC ..... *B05B 17/0669* (2013.01); *B05B 17/0676* (2013.01); *B05C 5/00* (2013.01); *B41J 2/04581* (2013.01); *B41J 2/04588* (2013.01); *B41J 2002/14338* (2013.01)

(58) Field of Classification Search

CPC ..... B05B 17/0669; B05B 17/0676; B41J 2/04588; B41J 2002/14338; B05C 5/00

USPC ..... 239/102.2

See application file for complete search history.

(56) References Cited

U.S. PATENT DOCUMENTS

| | | | | |
|---|---|---|---|---|
| 4,362,407 | A | 12/1982 | Kolm et al. | |
| 5,893,350 | A | 4/1999 | Timms | |
| 6,191,522 | B1 | 2/2001 | Reuter | |
| 6,749,126 | B1 * | 6/2004 | Ruehle | F02M 51/0603 239/102.1 |

(Continued)

FOREIGN PATENT DOCUMENTS

| | | | |
|---|---|---|---|
| DE | 10-2011-108799 | A1 | 1/2013 |
| EP | 1121249 | B1 | 7/2007 |

(Continued)

OTHER PUBLICATIONS

Extended European Search Report for Application No. EP 17 15 9251 dated Oct. 12, 2017 (6 pages).

(Continued)

*Primary Examiner* — Christopher Kim

(74) *Attorney, Agent, or Firm* — Harness, Dickey & Pierce, P.L.C.

(57) ABSTRACT

A fluid ejection device is a fluid ejection device adapted to eject a fluent material including an actuator, and a drive signal supply section adapted to output a signal used to drive the actuator, wherein the actuator includes a first piezoelectric element and a second piezoelectric element connected in series to each other. The drive signal supply section is capable of outputting a first drive waveform and a second drive waveform having a voltage change part steeper than that of the first drive waveform to the first piezoelectric element and the second piezoelectric element, outputs the second drive waveform to the second piezoelectric element in a case of outputting the first drive waveform to the first piezoelectric element, and outputs the first drive waveform to the second piezoelectric element in a case of outputting the second drive waveform to the first piezoelectric element.

6 Claims, 5 Drawing Sheets

(56) References Cited

U.S. PATENT DOCUMENTS

| | | | |
|---|---|---|---|
| 7,309,027 | B2 | 12/2007 | Magel et al. |
| 9,156,054 | B2 | 10/2015 | Ikushima |
| 9,339,839 | B2 | 5/2016 | Fliess et al. |
| 2002/0180844 | A1 | 12/2002 | Takahagi et al. |
| 2006/0256164 | A1 | 11/2006 | Hirota et al. |
| 2014/0291358 | A1 | 10/2014 | Fliess et al. |

FOREIGN PATENT DOCUMENTS

| | | | |
|---|---|---|---|
| JP | 04-365384 | A | 12/1992 |
| JP | 10-103183 | A | 4/1998 |
| JP | 2001-503920 | A | 3/2001 |
| JP | 2009-184358 | A | 8/2009 |
| JP | 2014-525831 | A | 10/2014 |
| WO | WO-2008-146464 | A1 | 12/2008 |

OTHER PUBLICATIONS

Extended European Search Report for Application No. EP 17 15 9266 dated Sep. 6, 2017 (6 pages).

* cited by examiner

FLUID EJECTION DEVICE

BACKGROUND

1. Technical Field

The present invention relates to a fluid ejection device.

2. Related Art

There has been known a fluid ejection device adapted to discharge to fly a droplet material using reciprocation of a moving object. In many cases, an actuator using a piezoelectric element or the like is used as a drive source for translating the moving object. Since the piezoelectric element can generate only a small amount of displacement, the amount of displacement is amplified via an amplification mechanism in the technology described in, for example, JP-T-2014-525831 (the term "JP-T" as used herein means a published Japanese translation of a PCT patent application).

However, if the amplification mechanism is used, the configuration becomes complicated, and there is a possibility of incurring growth in size of the drive device. Therefore, there has been desired a technology capable of providing a sufficient amount of displacement of a moving object without using the amplification mechanism in a fluid ejection device for discharging a droplet using reciprocation of the moving object.

SUMMARY

An advantage of some aspects of the invention is to solve at least a part of the problems described above, and the invention can be implemented as the following forms.

(1) According to an aspect of the invention, a fluid ejection device is provided. The fluid ejection device is a fluid ejection device adapted to eject a fluent material, the fluid ejection device including a fluent material chamber supplied with the fluent material, a moving object, which can reciprocate in the fluent material chamber, a nozzle part having a discharge port communicating with the fluent material chamber, and an inner wall on a periphery of the discharge port on which a tip part of the moving object can contact from the fluent material chamber side, an actuator having contact with a back end part of the moving object to reciprocate the moving object to thereby discharge the fluent material from the discharge port, and a drive signal supply section adapted to output a signal used to drive the actuator, wherein the actuator includes a first piezoelectric element and a second piezoelectric element connected in series to each other, an end of the second piezoelectric element having contact with the back end part of the moving object, the drive signal supply section is capable of outputting a first drive waveform and a second drive waveform having a voltage change part steeper than a voltage change part included in the first drive waveform respectively to the first piezoelectric element and the second piezoelectric element, and the drive signal supply section outputs the second drive waveform to the second piezoelectric element in a case of outputting the first drive waveform to the first piezoelectric element, and outputs the first drive waveform to the second piezoelectric element in a case of outputting the second drive waveform to the first piezoelectric element. According to the fluid ejection device having such a configuration, since the actuator for reciprocating the moving object is formed of a plurality of piezoelectric elements connected in series to each other, the sufficient displacement amount of the moving object can be obtained without using an amplification mechanism. Further, since it is possible to output the second drive waveform having the steep voltage change part to each of the first piezoelectric element and the second piezoelectric element, it is possible to prevent that the first piezoelectric element alone is deteriorated. Therefore, the durability of the actuator is improved.

(2) In the fluid ejection device according to the aspect of the invention, the drive signal supply section may make the tip part of the moving object come closer to the inner wall using at least a part of the first drive waveform, and the tip part of the moving object collide with the inner wall using the steeper voltage change part of the second drive waveform. According to such a configuration, since it is possible to make the moving object collide with the inner wall at high speed while keeping the sufficient stroke amount for filling the chamber with the fluent material, it is possible to discharge the material high in viscosity.

(3) In the fluid ejection device according to the aspect of the invention, the drive signal supply section may start outputting the second drive waveform after outputting the first drive waveform with respect to each of the first piezoelectric element and the second piezoelectric element. According to such a configuration, it is possible to reduce the generation of the unwanted vibration in the actuator compared to the case in which the first drive waveform and a part of the second drive waveform are output in an overlapping manner.

(4) In the fluid ejection device according to the aspect of the invention, that the drive signal supply section may be provided with a first drive signal supply section adapted to output the first drive waveform and the second drive waveform to the first piezoelectric element, and a second drive signal supply section adapted to output the first drive waveform and the second drive waveform to the second piezoelectric element. According to such a configuration, since it is possible to supply the drive signals individually to the first piezoelectric element and the second piezoelectric element, even if the first piezoelectric element and the second piezoelectric element are different in characteristics, it is possible to make the elements perform the expansion and contraction actions corresponding to the respective characteristics.

(5) In the fluid ejection device according to the aspect of the invention, the first piezoelectric element and the second piezoelectric element may be equal in resonance frequency to each other. According to such a configuration, it is possible to make the first piezoelectric element and the second piezoelectric element perform substantially the same expansion and contraction action as each other. Therefore, the control of the expansion and contraction action of the actuator becomes easy.

(6) In the fluid ejection device according to the aspect of the invention, the first drive waveform to be output to the first piezoelectric element and the first drive waveform to be output to the second piezoelectric element may be the same as each other, and the second drive waveform to be output to the first piezoelectric element and the second drive waveform to be output to the second piezoelectric element may be the same as each other. According to such a configuration, since it is possible to use the drive waveforms common to the first piezoelectric element and the second piezoelectric element, it becomes easy to control the expansion and contraction action of the actuator.

(7) In the fluid ejection device according to the aspect of the invention, the piezoelectric elements as a plurality of piezoelectric elements may be connected to each other via a contact part, and the contact part may have one of point contact and line contact with each of the first piezoelectric element and the second piezoelectric element. According to such a configuration, since the mutual heat generation of the piezoelectric elements does not affect each other, the durability of the piezoelectric elements is improved.

(8) The fluid ejection device according to the aspect of the invention may further include a biasing member adapted to bias the moving object in a direction from the discharge port toward the actuator. According to such a configuration, since the preliminary load can be applied by the biasing member to the piezoelectric elements, the durability of the piezoelectric elements is improved.

It should be noted that the invention can be implemented in a variety of forms such as a fluid ejection system, or a method of ejecting a fluid.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
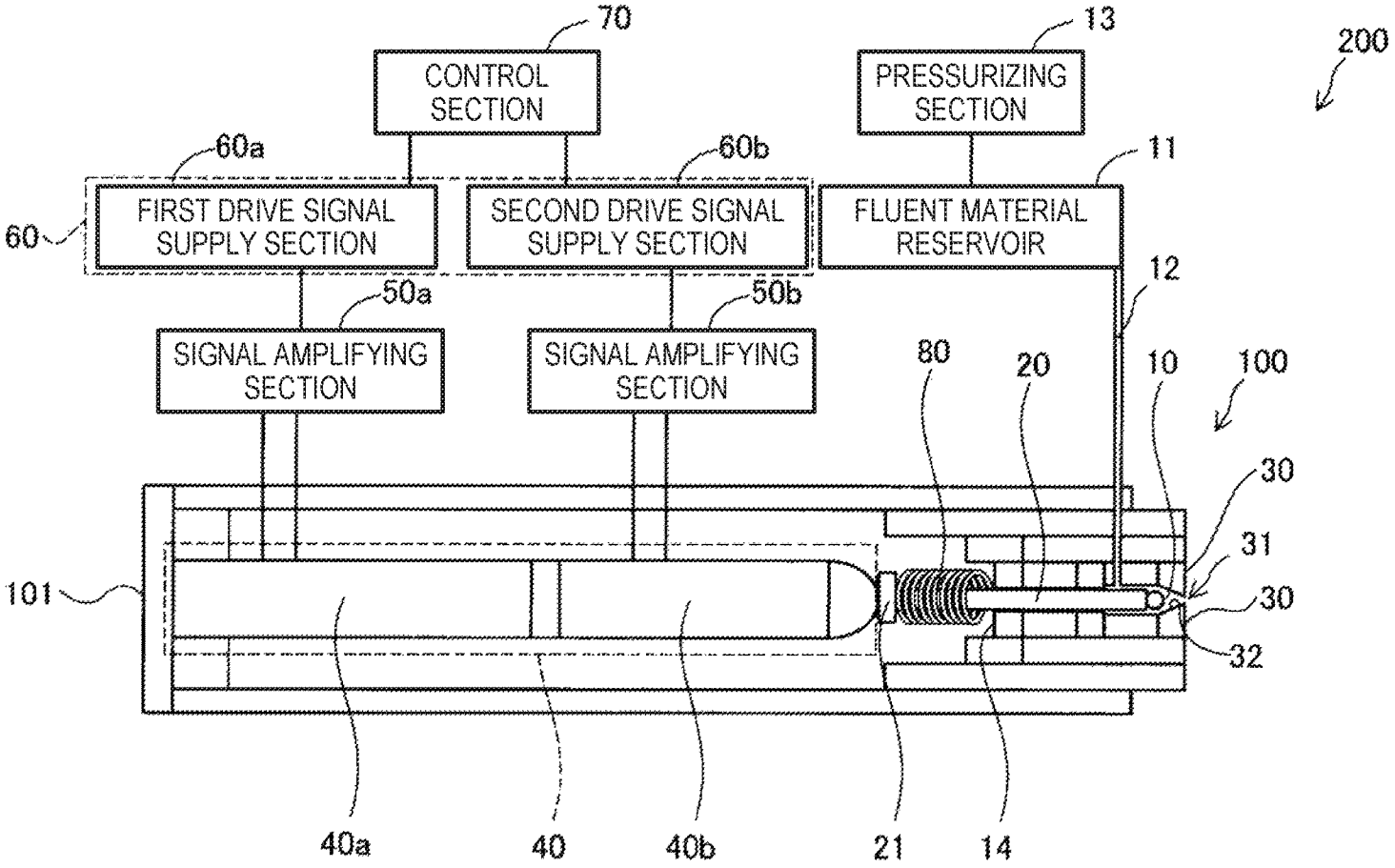
FIG. 1 is a schematic configuration diagram of a fluid ejection system including a fluid ejection device according to a first embodiment of the invention.

FIG. 1 is a schematic configuration diagram of a fluid ejection system 200 including a fluid ejection device 100 according to a first embodiment of the invention. The fluid ejection device 100 is, for example, a device used for a printer, and a device for discharging a minute amount of a variety of fluent materials in a range from a fluent material low in viscosity such as water, a solvent, or a reagent to a fluent material high in viscosity such as a solder paste, a silver paste, or an adhesive at high speed irrespective of presence or absence of a filler.

The fluid ejection system 200 is provided with the fluid ejection device 100, a fluent material reservoir 11, a flow channel 12, a pressurizing section 13, a drive signal supply section 60, and a control section 70. The fluid ejection device 100 is provided with a fluent material chamber 10, a moving object 20, a nozzle part 30, an actuator 40, and a biasing member 80. It should be noted that the fluid ejection system 200 can also be figured out as a fluid ejection device in a broad sense.

In the fluent material chamber 10, there is reserved a fluent material. The fluent material chamber 10 is supplied with the fluent material from the fluent material reservoir 11 through the flow channel 12. The fluent material reserved in the fluent material reservoir 11 is pressurized by the pressurizing section 13, and is thus supplied to the flow channel 12. In the fluent material chamber 10, there is disposed a tip part of the moving object 20 capable of reciprocating in the fluent material chamber 10. Further, on one side surface of the fluent material chamber 10, there is disposed the nozzle part 30 at a position opposed to the tip side of the moving object 20.

The nozzle part 30 has a discharge port 31 communicating with the fluent material chamber 10. The tip part of the moving object 20 is capable of having contact with an inner wall 32 on the periphery of the discharge port 31 from the fluent material chamber 10 side. The inner wall 32 is tilted to form a tapered shape. Due to the collision of the moving object 20 to the part having the tapered shape, the fluent material in the fluent material chamber 10 is discharged from the nozzle part 30.

The moving object 20 is, for example, a rod-like member having a tip shaped like a plane or a sphere, or having a tip provided with a projection. The moving object 20 is provided with the biasing member 80 in a back end part. The biasing member 80 biases the moving object 20 in a direction from the discharge port 31 toward the actuator 40. More specifically, the biasing member 80 is disposed so as to be sandwiched between a flange part 21 disposed on the back end part of the moving object 20 and a wall surface 14 on the actuator 40 side of the fluent material chamber 10, and therefore, the biasing member 80 biases the moving object 20 toward the actuator 40. Due to the biasing force by the biasing member 80, a preliminary load is applied to the actuator 40 (a first piezoelectric element 40*a*, a second piezoelectric element 40*b*). In the present embodiment, the biasing member 80 is formed of a compression coil spring. It should be noted that the biasing member 80 can also be formed of a different elastic member such as a rubber spring.

The actuator 40 is provided with the first piezoelectric element 40*a* and the second piezoelectric element 40*b* connected in series to each other. An end of the second piezoelectric element 40*b* has contact with the back end part of the moving object 20. An end part of the first piezoelectric element 40*a* located on an opposite side to the moving object 20 side is fixed to a housing 101 of the fluid ejection device 100. The actuator 40 reciprocates the moving object 20 to thereby discharge the fluent material from the discharge port 31.

In the present embodiment, the first piezoelectric element 40*a* and the second piezoelectric element 40*b* are each a piezoelectric element having a rod-like shape or a block-like shape expanding and contracting in the longitudinal direction. In the present embodiment, the first piezoelectric element 40*a* and the second piezoelectric element 40*b* are piezoelectric elements having the same characteristics. Specifically, the first piezoelectric element 40*a* and the second piezoelectric element 40*b* are the same in resonance frequency, expansion speed, and maximum amount of displacement. The first piezoelectric element 40*a* and the second piezoelectric element 40*b* are bonded to each other with an adhesive. As the adhesive, there can be used, for example, epoxy resin or acrylic adhesive.

A signal amplifying section 50*a* is connected to the first piezoelectric element 40*a*, and a signal amplifying section 50*b* is connected to the second piezoelectric element 40*b*. The drive signal supply section 60 is connected to the signal amplifying sections 50*a*, 50*b* and the control section 70. The signal amplifying sections 50*a*, 50*b* output signals for driving the piezoelectric elements 40*a*, 40*b* connected to the signal amplifying sections 50*a*, 50*b*, respectively.

The drive signal supply section 60 generates drive signals for driving the actuator 40. In the present embodiment, the drive signal supply section 60 is provided with a first drive signal supply section 60*a* and a second drive signal supply section 60*b*. The first drive signal supply section 60*a* generates the drive signal to be supplied to the first piezoelectric element 40*a*. The second drive signal supply section 60*b* generates the drive signal to be supplied to the second piezoelectric element 40*b*. The drive signals generated by the drive signal supply sections 60*a*, 60*b* are amplified by the respective signal amplifying sections 50*a*, 50*b*, and are then applied to the respective piezoelectric elements 40*a*, 40*b*. Generation of the drive signals by the drive signal supply sections 60*a*, 60*b* is controlled by the control section 70.

Figure 2:
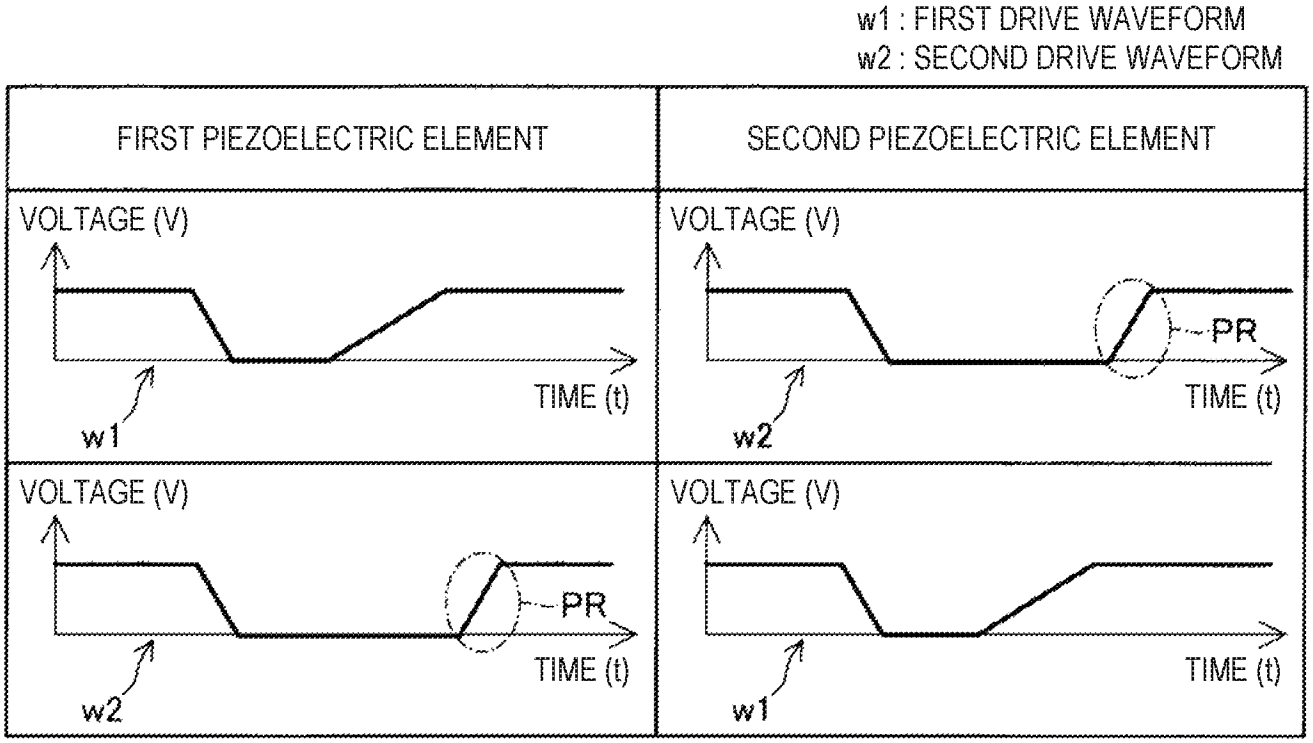
FIG. 2 is a diagram showing a schematic shape of a drive waveform.

FIG. 2 is a diagram showing schematic shapes of a first drive waveform w1 and a second drive waveform w2 output to the respective piezoelectric elements 40*a*, 40*b* in the present embodiment. In the present embodiment, due to the control by the control section 70, the first drive signal supply section 60*a* is capable of outputting the first drive waveform w1 and the second drive waveform w2 to the first piezoelectric element 40*a*, and the second drive signal supply section 60*b* is capable of outputting the first drive waveform w1 and the second drive waveform w2 to the second piezoelectric element 40*b*. Further, the drive signal supply section 60 outputs the second drive waveform w2 from the second drive signal supply section 60*b* to the second piezoelectric element 40*b* in the case of outputting the first drive waveform w1 from the first drive signal supply section 60*a* to the first piezoelectric element 40*a*, and outputs the first drive waveform w1 from the second drive signal supply section 60*b* to the second piezoelectric element 40*b* in the case of outputting the second drive waveform w2 from the first drive signal supply section 60*a* to the first piezoelectric element 40*a*.

Further, the drive signal supply section 60 starts outputting the second drive waveform w2 after outputting the first drive waveform w1 with respect to each of the first piezoelectric element 40*a* and the second piezoelectric element 40*b*. Therefore, in the present embodiment, it results that the first drive waveform w1 and the second drive waveform w2 are alternately output to the first piezoelectric element 40*a* and the second piezoelectric element 40*b*.

In the present embodiment, the first drive waveform to be output to the first piezoelectric element 40*a* and the first drive waveform to be output to the second piezoelectric element 40*b* are the same as each other, and the second drive waveform to be output to the first piezoelectric element 40*a* and the second drive waveform to be output to the second piezoelectric element 40*b* are the same as each other. The second drive waveform w2 has a voltage change part PR steeper than a voltage change part included in the first drive waveform w1. When the steep voltage change part PR is applied to the first piezoelectric element 40*a* or the second piezoelectric element 40*b*, the moving speed of the moving object 20 is increased due to the rapid expansion of the first piezoelectric element 40*a* or the second piezoelectric element 40*b*, and thus, the fluent material 15 is discharged from the discharge port 31.

Figure 3:
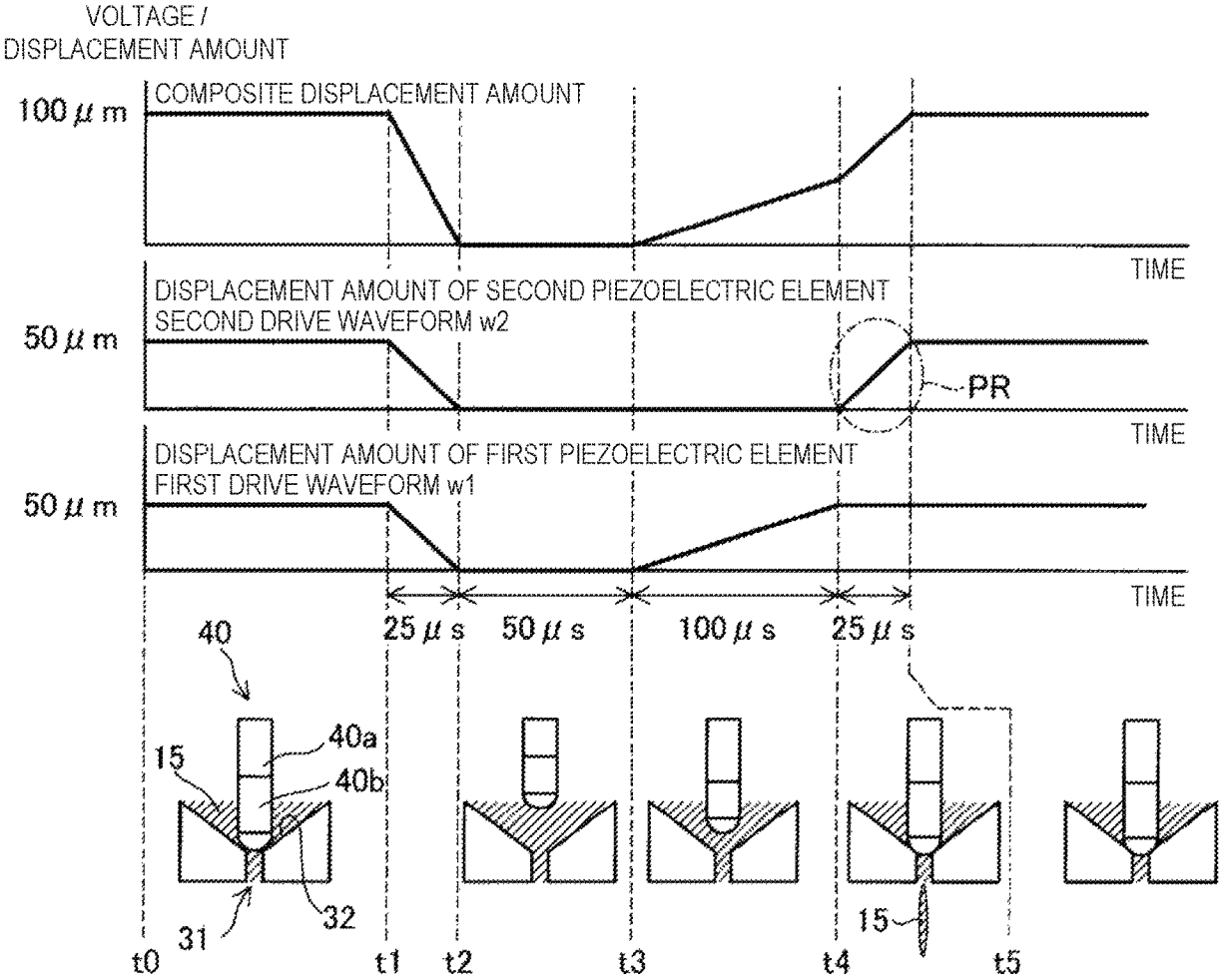
FIG. 3 is an explanatory diagram showing changes in state until a fluent material is discharged.

FIG. 3 is an explanatory diagram showing the state change occurring until the fluent material 15 is discharged when applying the first drive waveform w1 to the first piezoelectric element 40*a* and applying the second drive waveform w2 to the second piezoelectric element 40*b*. The horizontal axis of each of the graphs represents time (μs), and the vertical axis of the graphs represents the displacement amounts (μm) and the voltages of the piezoelectric elements 40*a*, 40*b*. The graph shown in the highest area represents a composite displacement amount obtained by combining the displacement amount of the first piezoelectric element 40*a* and the displacement amount of the second piezoelectric element 40*b* with each other. It should be noted that the drive waveforms are simplified on the assumption that the drive waveforms behave similarly to the displacement amounts of the respective piezoelectric elements. Further, in order to show the operation of the fluid ejection device 100 in a simplified manner, in the lower part of the drawing, there is shown a condition in which the actuator 40 has direct contact with the discharge port 31 to discharge the fluent material 15.

The period from the timing t0 to the timing t1 corresponds to the state in which voltages are applied to both of the piezoelectric elements 40*a*, 40*b*, and both of the piezoelectric elements 40*a*, 40*b* are expanded to the maximum. In the period (25 μs) from the timing t1 to the timing t2, the first piezoelectric element 40*a* and the second piezoelectric element 40*b* are contracted due to fall of both of the first drive waveform w1 and the second drive waveform w2. At the timing t2, the first piezoelectric element 40*a* and the second piezoelectric element 40*b* are contracted to the minimum.

In the period (50 μs) from the timing t2 to the timing t3, there is no variation in any of the drive waveforms w1, w2 and the first piezoelectric element 40*a* and the second piezoelectric element 40*b*. In this period, the fluent material chamber 10 is filled with the fluent material 15 from the fluent material reservoir 11.

In the period (100 μs) from the timing t3 to the timing t4, the first piezoelectric element 40*a* is expanded due to gradual rise of the first drive waveform w1. At the timing t4, the first piezoelectric element 40*a* expands to the maximum displacement amount, and then, the steep voltage change part PR of the second drive waveform w2 is applied to the second piezoelectric element 40*b*.

In the period (25 μs) from the timing t4 to the timing t5, the second piezoelectric element 40*b* located on the tip side is rapidly expanded due to application of the steep voltage change part PR in the second drive waveform w2 to the second piezoelectric element 40*b*. Therefore, at the timing t5, the moving object 20 (not shown in FIG. 3) thus accelerated collides with the inner wall 32, and thus, the fluent material 15 is discharged from the discharge port 31.

Figure 4:
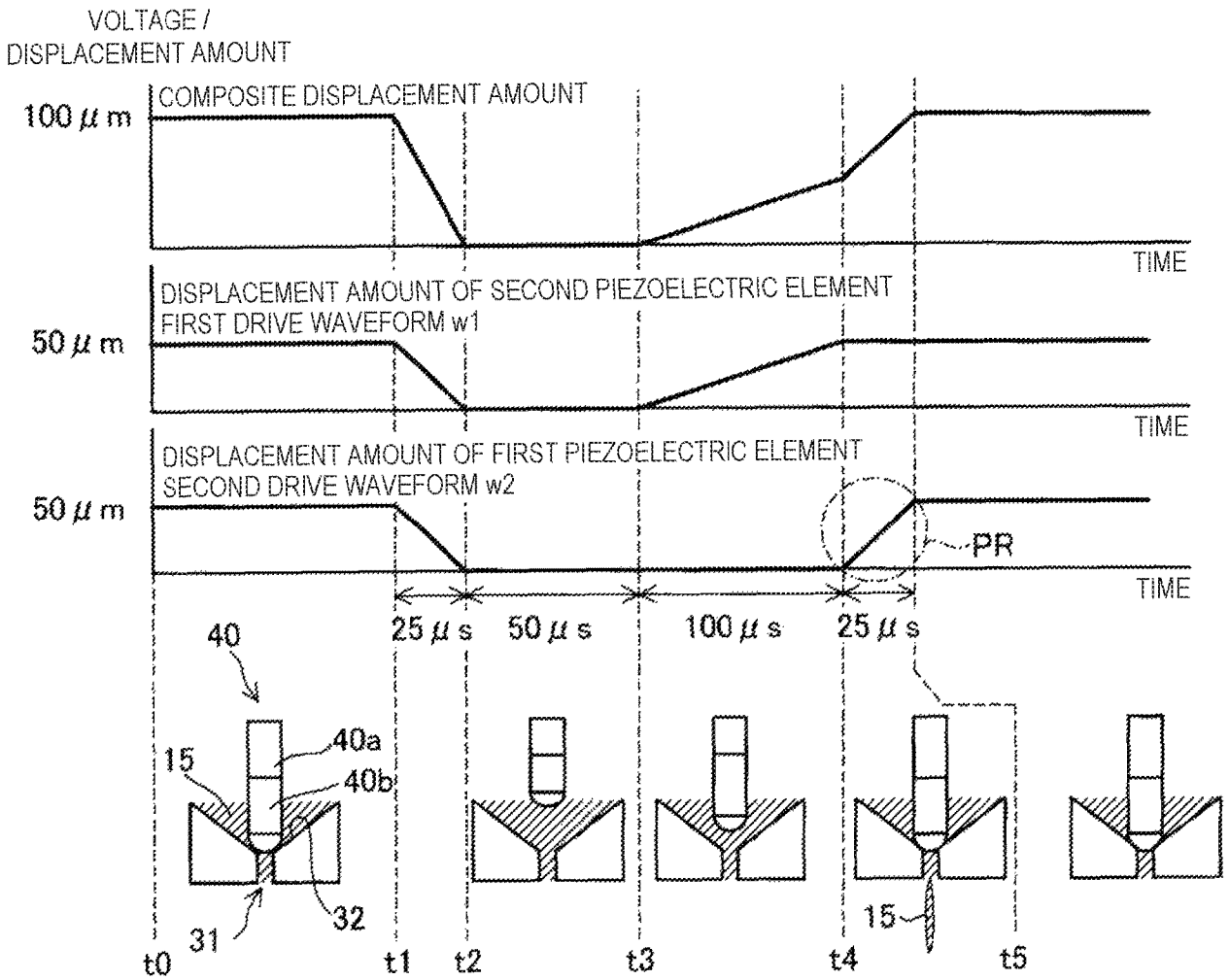
FIG. 4 is an explanatory diagram showing changes in state until a fluent material is discharged.

FIG. 4 is an explanatory diagram showing the state change occurring until the fluent material 15 is discharged when applying the second drive waveform w2 to the first piezoelectric element 40*a* and applying the first drive waveform w1 to the second piezoelectric element 40*b*. As shown in FIG. 4, in the case of applying the second drive waveform w2 to the first piezoelectric element 40*a* and applying the first drive waveform w1 to the second piezoelectric element 40*b*, the second piezoelectric element 40*b* expands first, and then the first piezoelectric element 40*a* expands. Even in such an operation, due to the rapid expansion of the first piezoelectric element 40*a* located on the back end side, the fluent material 15 is discharged from the discharge port 31.

In the present embodiment, the operation shown in FIG. 3 and the operation shown in FIG. 4 are repeatedly performed alternately once for each term in the first piezoelectric element 40*a* and the second piezoelectric element 40*b*.

According to the fluid ejection device 100 related to the present embodiment described hereinabove, since the plurality of piezoelectric elements 40*a*, 40*b* is connected in series to each other, it is possible to increase the displacement amount of the moving object 20 without using the amplification mechanism. As a result, the size of the actuator 40 can be reduced. Further, since it is possible to output the second drive waveform w2 having the steep voltage change part PR to each of the first piezoelectric element 40*a* and the second piezoelectric element 40*b*, it is possible to prevent that the first piezoelectric element 40*a* alone is deteriorated. Therefore, the durability of the piezoelectric element 40*a* is improved.

Further, in the present embodiment, due to the first drive waveform w1, the tip part of the moving object 20 is made to come closer to the inner wall 32 on the periphery of the discharge port 31, and then the tip part of the moving object 20 is made to collide with the inner wall 32 using the steep voltage change part PR of the second drive waveform w2. Therefore, since it is possible to make the moving object 20 collide with the inner wall 32 at high speed while keeping the sufficient stroke amount for filling the chamber with the fluent material 15, it is possible to discharge the material high in viscosity.

Further, in the present embodiment, since the output of the second drive waveform w2 is started after outputting the first drive waveform w1 to each of the piezoelectric elements 40*a*, 40*b*, it is possible to reduce the generation of the unwanted vibration in the actuator 40 compared to the case in which the first drive waveform w1 and a part of the second drive waveform w2 are output in an overlapping manner.

Further, since in the present embodiment, it is possible to supply the drive signals individually from the drive signal supply sections 60*a*, 60*b* to the first piezoelectric element 40*a* and the second piezoelectric element 40*b*, even if the first piezoelectric element 40*a* and the second piezoelectric element 40*b* are different in characteristics, it is possible to make the elements perform the expansion and contraction actions corresponding to the respective characteristics.

Further, in the present embodiment, since the resonance frequencies of the first piezoelectric element 40*a* and the second piezoelectric element 40*b* are equal to each other, it is possible to make the first piezoelectric element 40*a* and the second piezoelectric element 40*b* perform the expansion and contraction actions substantially the same as each other. Therefore, the control of the expansion and contraction action of the actuator 40 becomes easy.

Further, in the present embodiment, since the first drive waveform w1 to be output to the first piezoelectric element 40*a* and the first drive waveform w1 to be output to the second piezoelectric element 40*b* are the same as each other, and the second drive waveform w2 to be output to the first piezoelectric element 40*a* and the second drive waveform w2 to be output to the second piezoelectric element 40*b* are the same as each other, it is possible to use the drive waveforms common to the first piezoelectric element 40*a* and the second piezoelectric element 40*b*. Therefore, the control of the expansion and contraction action of the actuator 40 becomes easy.

Further, in the present embodiment, since the preliminary load is applied by the biasing member 80 to the piezoelectric elements 40*a*, 40*b*, the durability of the piezoelectric elements 40*a*, 40*b* is improved.

B. Second Embodiment

Figure 5:
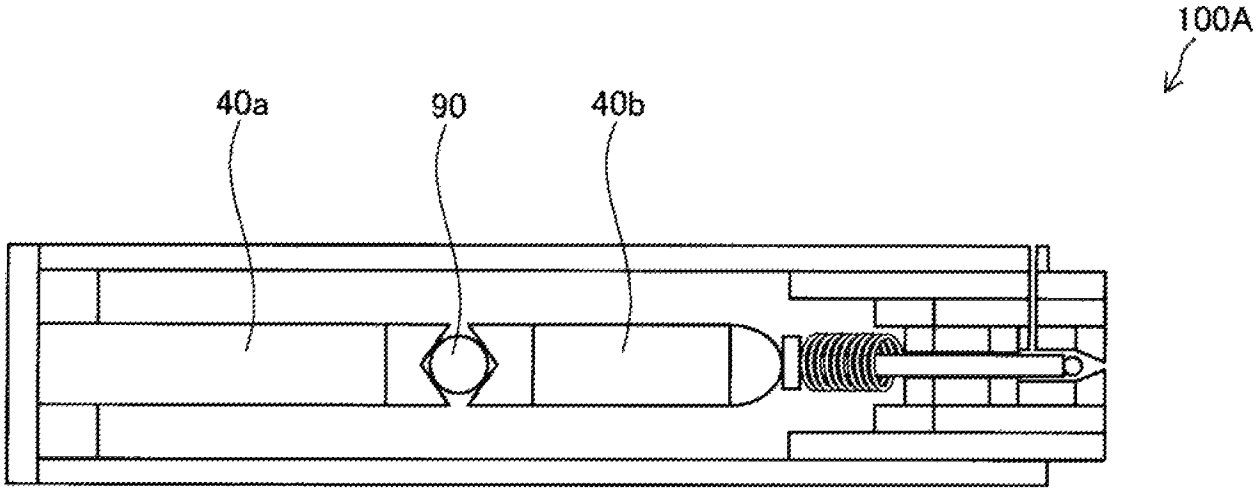
FIG. 5 is a schematic configuration diagram of a fluid ejection device according to a second embodiment.

FIG. 5 is a schematic configuration diagram of a fluid ejection device 100A according to a second embodiment of the invention. The fluid ejection device 100A according to the present embodiment is different from the first embodiment in the point that the piezoelectric elements 40*a*, 40*b* are connected to each other via a contact part 90, and is the same as the first embodiment in the rest of the configuration.

The fluid ejection device 100A according to the present embodiment is provided with the contact part 90 shaped like a true sphere. The end surfaces of the first piezoelectric element 40*a* and the second piezoelectric element 40*b* having contact with the contact part 90 are each recessed to form a tapered shape. Therefore, the contact part 90 and each of the piezoelectric elements 40*a*, 40*b* have line contact with each other. The contact part 90 is a rigid body, and is formed of metal or ceramic.

According to the fluid ejection device 100 related to the present embodiment described hereinabove, since mutual heat generation of the piezoelectric elements 40*a*, 40*b* does not affect each other, the durability of the piezoelectric elements 40*a*, 40*b* is improved.

C. Modified Examples

First Modified Example

In each of the embodiments described above, the first piezoelectric element 40*a* and the second piezoelectric element 40*b* are not required to be equal to each other in resonance frequency, expansion speed, or maximum displacement amount. The first drive waveform and the second drive waveform applied to the first piezoelectric element 40*a*, and the first drive waveform and the second drive waveform applied to the second piezoelectric element 40*b* can also be different drive waveforms from each other in accordance with the resonance frequencies, the expansion speeds, and the maximum displacement amounts of the respective piezoelectric elements so that the piezoelectric elements behave in the same way.

Second Modified Example

In each of the embodiments described above, the moving object 20 and the second piezoelectric element 40*b* can also be bonded with an adhesive without disposing the biasing member 80.

Third Modified Example

In each of the embodiments described above, the application operations shown in FIG. 3 and FIG. 4 can be switched alternately every time, or can also be switched after performing each of the application operations two or more times. Further, it is not required to uniform the number of times of the operation shown in FIG. 3 and the number of times of the operation shown in FIG. 4.

Fourth Modified Example

In the second embodiment, it is also possible to use a flat surface as the end surface of each of the first piezoelectric element 40*a* and the second piezoelectric element 40*b* having contact with the contact part 90 to thereby make the contact part 90 and each of the piezoelectric elements 40*a*, 40*b* have point contact with each other. Further, it is also possible to make one have point contact with each other, and the other have line contact with each other.

The invention is not limited to the embodiments and the modified examples described above, but can be implemented with a variety of configurations within the scope or the spirit of the invention. For example, the technical features in the embodiments and the modified examples corresponding to the technical features in the aspects described in the SUMMARY section can arbitrarily be replaced or combined in order to solve the problems described above, or in order to achieve all or a part of the advantages described above. Further, the technical feature can arbitrarily be eliminated unless described in the specification as an essential element.

The entire disclosure of Japanese Patent Application No. 2016-040814, filed Mar. 3, 2016 is expressly incorporated by reference herein.

What is claimed is:

1. A fluid ejection device adapted to eject a fluent material comprising:

a fluent material chamber supplied with the fluent material;

a reciprocating rod that is configured to reciprocate in the fluent material chamber;

a nozzle having a discharge port, the nozzle fluidly communicating with the fluent material chamber, a tip of the rod being configured to abut an inner wall of the discharge port;

an actuator that is configured with first and second piezoelectric elements that are connected in series, an end of the second piezoelectric element being configured to contact a back end of the rod so as to reciprocate the rod and discharge the fluent material from the discharge port; and a drive signal generator that is configured to output first and second drive waveforms so as to drive the actuator, the first and second drive waveforms having first and second voltage changes, respectively, wherein the second voltage change is steeper than the first voltage change, and an end of the first voltage change is aligned with a beginning of the second voltage change, the drive signal generator is configured to output the second drive waveform to the second piezoelectric element when the drive signal generator is configured to output the first drive waveform to the first piezoelectric element, and the drive signal generator is configured to output the first drive waveform to the second piezoelectric element when the drive signal generator is configured to output the second drive waveform to the first piezoelectric element, and the actuator is configured to move the rod so that the tip of the rod abuts the inner wall of the discharge port in the second voltage change.

2. The fluid ejection device according to claim 1, wherein actuator is configured to move the rod so that the tip of the rod comes closer to but is spaced apart from the inner wall of the discharge port in the first voltage change.

3. The fluid ejection device according to claim 1, wherein the drive signal generator is configured with a first drive signal generator and a second drive signal generator, and each of the first and second drive signal generators is configured to output the first and second drive waveforms.

4. The fluid ejection device according to claim 1, wherein the first piezoelectric element and the second piezoelectric element are equal in resonance frequency to each other.

5. The fluid ejection device according to claim 1, wherein

The first and second piezoelectric elements are connected to each other via a contact part, and the contact part has one of point contact and line contact with each of the first piezoelectric element and the second piezoelectric element.

6. The fluid ejection device according to claim 1, further comprising:

a biasing member that is configured to bias the rod away from the discharge port and toward the actuator.

* * * * *